US007614940B2

(12) United States Patent
Jerome et al.

(10) Patent No.: US 7,614,940 B2
(45) Date of Patent: Nov. 10, 2009

(54) ACCESSORY WITH HUB FOR USE WITH MULTIPLE TYPES OF ROTARY TOOL MANDRELS

(75) Inventors: Gavin Jerome, Park Ridge, IL (US); Ralf Steiner, Bad Krozingen (DE)

(73) Assignee: Robert Bosch GmbH, Stuttgart (DE)

( * ) Notice: Subject to any disclaimer, the term of this patent is extended or adjusted under 35 U.S.C. 154(b) by 465 days.

(21) Appl. No.: 11/387,670

(22) Filed: Mar. 23, 2006

(65) Prior Publication Data

US 2007/0248429 A1 Oct. 25, 2007

(51) Int. Cl.
*B24B 41/00* (2006.01)

(52) U.S. Cl. ..... 451/360; 451/508; 451/510

(58) Field of Classification Search ..... 451/358, 451/359, 360, 508, 509, 510, 495; 409/234; 433/134, 135

See application file for complete search history.

(56) References Cited

U.S. PATENT DOCUMENTS

| | | | | |
|---|---|---|---|---|
| 480,121 | A | | 8/1892 | Nichols |
| 505,121 | A | | 9/1893 | Nelson |
| 514,882 | A | | 2/1894 | Elliott |
| 583,472 | A | | 6/1897 | Heath, Jr. |
| 769,426 | A | | 9/1904 | Zeran |
| 1,333,054 | A | | 3/1920 | Abbott |
| 1,941,840 | A | | 1/1934 | Kelsey |
| 2,276,067 | A | | 3/1942 | Siqveland |
| 4,200,947 | A | * | 5/1980 | Ali ..... 15/198 |
| 4,624,876 | A | * | 11/1986 | Nevin ..... 428/66.6 |
| 6,676,499 | B1 | | 1/2004 | Stewart, II |
| 2003/0129928 | A1 | * | 7/2003 | Moellenberg et al. ..... 451/51 |
| 2007/0281595 | A1 | * | 12/2007 | Treffner ..... 451/505 |

FOREIGN PATENT DOCUMENTS

| | | |
|---|---|---|
| EP | 1 745 889 | 1/2007 |
| EP | 1 745 890 | 1/2007 |
| GB | 785 330 | 10/1957 |

* cited by examiner

*Primary Examiner*—Eileen P. Morgan
(74) *Attorney, Agent, or Firm*—Maginot, Moore & Beck LLP

(57) ABSTRACT

An accessory with a hub for mounting on rotary tool mandrels of different types is disclosed. In one embodiment, the rotary tool accessory includes a work portion and a hub portion operably connected to the work portion for rotating the work portion. The hub portion includes a first mandrel mounting portion on a first side of the hub portion for mounting with a first mandrel type and a second mandrel mounting portion on a second side of the hub portion for mounting with a second mandrel type, wherein the second mandrel type is different from the first mandrel type.

20 Claims, 7 Drawing Sheets

ACCESSORY WITH HUB FOR USE WITH MULTIPLE TYPES OF ROTARY TOOL MANDRELS

BACKGROUND

This invention relates to the field of hand held rotary tools and related accessories.

Hand held rotary tools are widely used by many people, including craftspeople, homeowners, and artists. These rotary tools typically include an outer housing designed to be easily held within a human hand. The housing retains an electric motor which is operable to drive a rotatable chuck of the rotary tool. A mandrel may be releasably coupled to the chuck so as to be rotatably driven by the rotary tool. In turn, an accessory may be releasably secured to the mandrel thereby enabling the rotary tool to rotatably drive the accessory. The accessory may be a cut-off wheel, a polishing wheel, a grinding wheel, a sanding disc, or any other similar member.

There exists a variety of mandrels that are configured to releasably secure an accessory thereto. One such mandrel includes a base having a threaded aperture and a clamping screw that cooperate to clamp the accessory to the mandrel between the base and the clamping screw. With the accessory so clamped, rotation of the mandrel by the rotary tool causes rotation of the accessory thereby allowing the user to perform work on a workpiece.

In order to change an accessory that is secured to a mandrel of the type described above, it is typically necessary to loosen and remove the clamping screw from the base. Of course, in order to loosen the clamping screw, the user must first obtain an appropriately sized screwdriver, which may not be immediately available to the user. Furthermore, some users find the task of turning a screw tedious. Also, once the clamping screw is separated from meshing engagement from the base, the clamping screw is susceptible to being inadvertently dropped and lost since it is a relatively small, separate component.

Mandrels that overcome the shortcomings of the threaded aperture mandrel are disclosed in U.S. patent application Ser. Nos. 11/187,139 and Ser. No. 11/187,140, both filed on Jul. 21, 2005, which are herein incorporated by reference. The mandrels disclosed in these two applications incorporate a specifically configured coupling portion which is used with a complimentarily formed hub component on an accessory to removably couple the accessory to the mandrel.

While the mandrels with specifically configured coupling portions are a significant improvement over the threaded aperture mandrels, the availability of multiple types of mandrels presents various problems. By way of example, to account for multiple mandrel types, a manufacturing entity must be tooled to produce accessories that are compatible with both types of mandrels. Thus, for each accessory manufactured, such as a cut-off wheel, a polishing wheel, a grinding wheel, a sanding disc, or any other similar accessory, at least two different hub components must be manufactured for each type of accessory. Moreover, each type of accessory must be specially marked to identify the particular type of mandrel the accessory is to be used with.

The use of multiple types of mandrels by consumers presents additional problems in a retail setting. As an initial matter, when exhibiting a single type of accessory, each mandrel type should be separately displayed. Thus, valuable shelf space is lost merely to provide for each type of mandrel. Moreover, each additional type of mandrel increases the administrative burden of properly stocking an adequate number of accessories. Finally, it is inevitable that some customers will purchase an accessory designed for a mandrel other than the type owned by the customers. This leads to additional administrative burdens on the retailer as well as delay and frustration for the customers.

What is needed is a configuration for an accessory that reduces the problems associated with the use by consumers of multiple types of mandrels. It would be beneficial if the configuration was easily incorporated into the manufacturing process and could be used with multiple types of accessories.

SUMMARY

In accordance with one embodiment of the present invention, there is provided a rotary tool accessory with a work portion and a hub portion operably connected to the work portion for rotating the work portion. The hub portion includes a first mandrel mounting portion on a first side of the hub portion for mounting with a first mandrel type and a second mandrel mounting portion on a second side of the hub portion for mounting with a second mandrel type, wherein the second mandrel type is different from the first mandrel type.

In accordance with another embodiment of the present invention, there is provided a rotating tool accessory mounting hub with a first mounting element configured to receive a complimentarily keyed mandrel for mounting the hub to the keyed mandrel. The hub includes a second mounting element configured to be compressed against a mandrel having a threaded bore, the second mounting element defining a hole sized to allow the shaft of a screw to pass therethrough.

Pursuant to yet another embodiment there is provided a rotary tool accessory that includes a work portion and a first mounting element operably connected to the work portion for rotating the work portion. The first mounting element includes a slot for receiving a keyed portion of a mandrel. The accessory also includes a second mounting element operably connected to the work portion for rotating the work portion and including a bore for receiving the shaft of a screw.

DESCRIPTION

Figure 1:
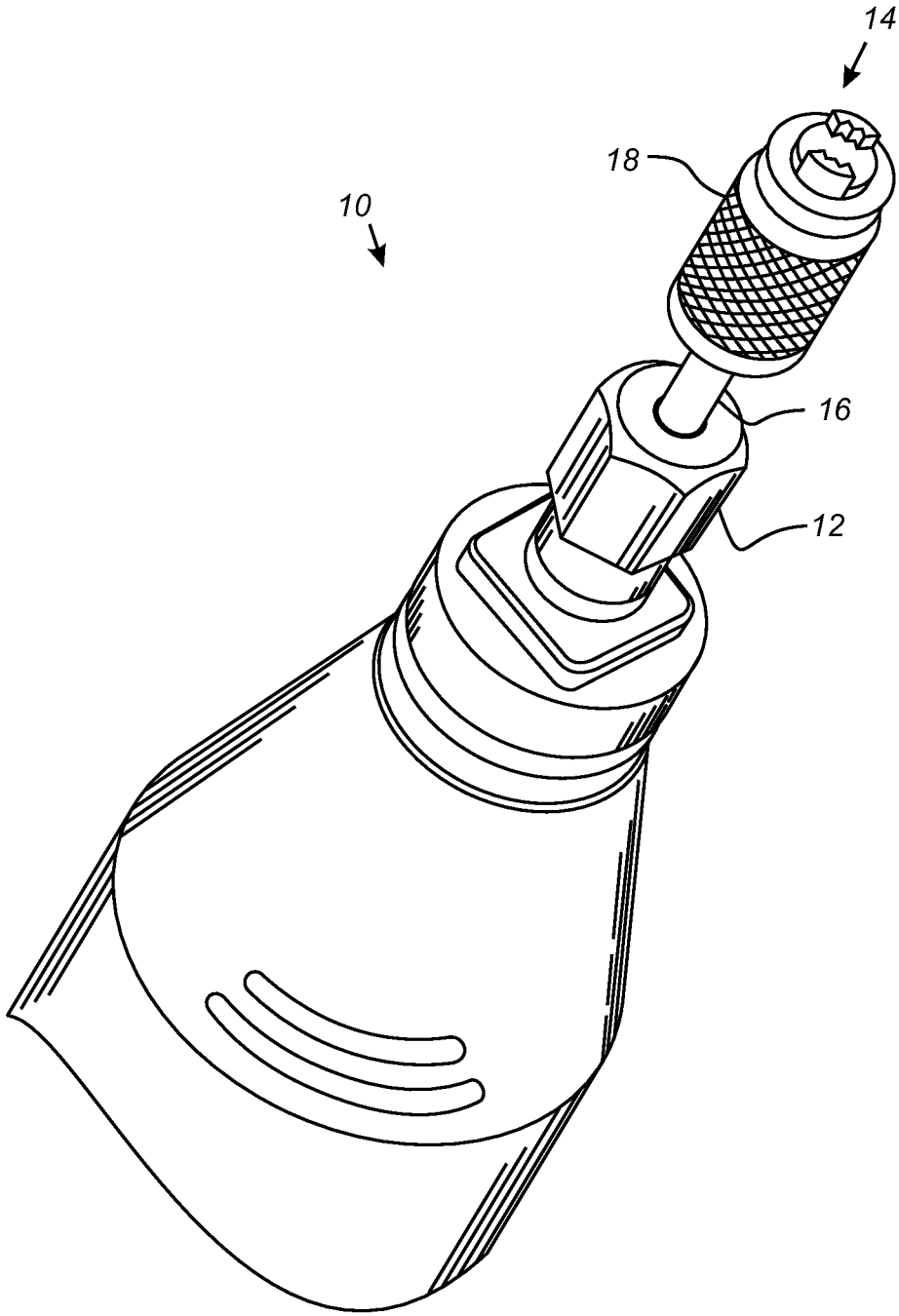
FIG. 1 shows a partial perspective view of a keyed mandrel assembly coupled with a rotary tool that may be used with an accessory in accordance with principles of the present invention.

FIG. 1 shows a partial perspective view of a rotary tool 10. The rotary tool 10 includes a motor (not shown) for providing rotational movement to a chuck 12. A mandrel assembly 14 is releasably coupled to the chuck 12. The mandrel assembly 14 includes a mandrel shaft 16 and a collar 18 slideable along the mandrel shaft 16. Operation of the rotary tool 10 rotates the chuck 12 which in turn rotates the mandrel shaft 16.

Figure 2:
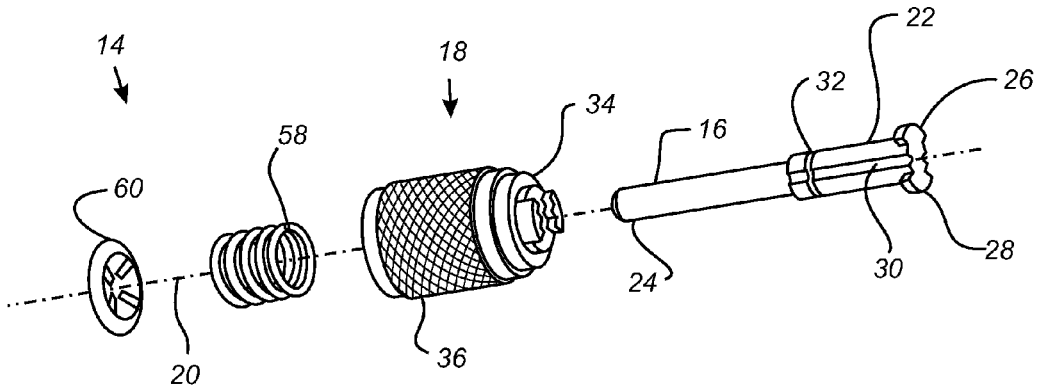
FIG. 2 shows an exploded perspective view of the keyed mandrel assembly of FIG. 1.

The mandrel shaft 16 is comprised of a rigid material, such as steel. Referring to FIG. 2, the mandrel shaft 16 defines a mandrel axis 20 and includes a first end portion 22 and a second end portion 24. The first end portion 22 of the mandrel shaft 16 comprises two opposite shaft teeth 26 and 28 extending from the end of the mandrel shaft 16 perpendicular to the mandrel axis 20. The shaft teeth 26 and 28 are generally arc or fan shaped when viewed individually. When viewed together, the shaft teeth 26 and 28 form a key generally in the shape of a bow-tie as is seen in FIG. 2.

Elongated grooves 30 (only one is shown in FIG. 2) are formed on opposite sides of the first end portion 22 of the mandrel shaft 16. The elongated grooves 30 are parallel to the mandrel axis 20. A circular groove 32 on the first end portion 22 extends circumferentially about the mandrel axis 20 and intersects the elongated grooves 30. The second end portion 24 of the mandrel shaft 16 in this embodiment is generally cylindrical in shape and is configured to be received within the chuck 12 of the rotary tool 10.

Figure 3:
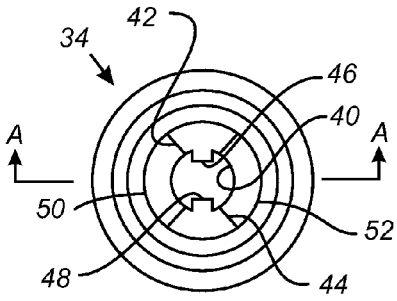
FIG. 3 shows a top plan view of the head portion of the keyed mandrel assembly of FIG. 1.
Figure 4:
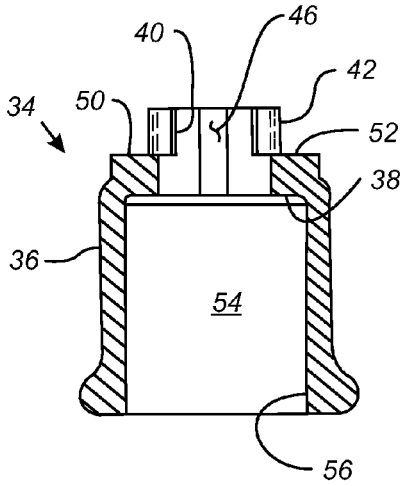
FIG. 4 shows a cross-sectional view of the head portion of FIG. 3.

With reference to FIGS. 2 and 3, the collar 18 is cylindrical in shape and made from a rigid material such as steel. The collar 18 includes a head portion 34 with a skirt 36 depending from the head portion 34. As shown in FIG. 4, the head portion 34 includes a circular head wall 38 positioned perpendicular to the skirt 36. An opening 40 is provided through the head portion 34, including the circular head wall 38. The opening 40 is designed and dimensioned to receive the mandrel shaft 16.

Returning to FIG. 3, two opposing collar teeth 42 and 44 extend from the head portion 34 about the opening 40, but do not completely block the opening 40. The collar teeth 42 and 44 are each individually arc or fan shaped and together define two flared portions of a bow-tie shape. The collar teeth 42 and 44 include tangs 46 and 48. Each tang 46 or 48 extends toward the opposing collar tooth 42 or 44. The tangs 46 and 48 are configured to be received within the elongated grooves 30 of the mandrel shaft 16. The head portion 34 further includes two landing areas 50 and 52.

As best seen in FIG. 4, the opening 40 in the collar 18 feeds into a cylindrical area 54 defined by the inner wall 56 of the skirt 36. This cylindrical area 54 has a diameter greater than that of the mandrel shaft 16, and is dimensioned to receive a spring 58 (see FIG. 2) positioned around the mandrel shaft 16. A retainer 60, which may be a pressure washer, is also provided.

To assemble the mandrel assembly 14, the elongated grooves 30 are aligned with the tangs 46 and 48 on the collar teeth 42 and 44 and the mandrel shaft 16 is inserted into the opening 40. When fully inserted, the opposing shaft teeth 26 and 28 abut the head portion 34 of the collar 18 at the landing areas 50 and 52. The spring 58 is then inserted within the inner wall 56 of the collar 18 and about the mandrel shaft 16. The retainer 60 is then moved along the mandrel shaft 16 until it snaps into the circular groove 32. At this point, the spring 58 is under compression and is retained about the mandrel shaft 16 between the retainer 52 and the circular head wall 38 of the collar 18. The spring 58 biases the collar 18 away from the second end portion 24 of the shaft 16. The retainer 60 provides a stop for the collar 18, allowing the collar 18 to slide along the mandrel shaft 16 between a first position in which the landing areas 50 and 52 are pressed against the shaft teeth 26 and 28 and a second position in which the spring 58 is compressed with the landing areas 50 and 52 spaced apart from the shaft teeth 26 and 28.

With the tangs 46 and 48 of the collar teeth 42 and 44 properly positioned in the elongated grooves 30 of the shaft 16, the collar teeth 42 and 44 are angularly offset from the shaft teeth 26 and 28. This angular offset allows movement of the shaft teeth 26 and 28 along the collar teeth 42 and 44 and the axis 20, so that the shaft teeth 26 and 28 may be in the same plane as the collar teeth 42 and 48, such as when they abut the landing areas 50 and 52. Alternatively, they may be moved to a position above the plane of the collar teeth 42 and 48, so as to be spaced apart from the landing areas 50 and 52. Advantageously, the tangs 46 and 48 slide along the elongated grooves 30 on the mandrel shaft 16 during movement of the collar 18 in the axial direction, and thereby prevent rotation of the collar 18 with respect to the shaft 16 which would disturb the angular offset relationship between the collar teeth 42 and 44 and the shaft teeth 26 and 28.

Figure 5:
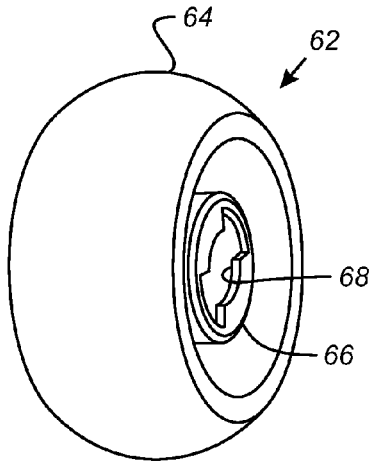
FIG. 5 shows a front perspective view of an accessory in the form of a buffing wheel for use with the mandrel assembly of FIG. 1 incorporating principles of the present invention.

Various accessories may be attached to the mandrel assembly 14. One such accessory shown in the embodiment of FIG. 5 is accessory 62 which is configured as a buffing wheel. The buffing wheel 62 includes a work portion 64 and a central hub 66. A slot 68 is formed in an outer wall 70 of the central hub 66. The slot 68 is complimentarily configured to receive the keys formed by the shaft teeth 26 and 28 as well as the collar teeth 42 and 48. To this end, as shown in FIG. 6, the slot 68 is configured generally in the shape of a bow-tie having two outer fan shaped portions 72 and 74 which are separated by two protrusions 76 and 78 which extend into the slot 68.

Figure 6:
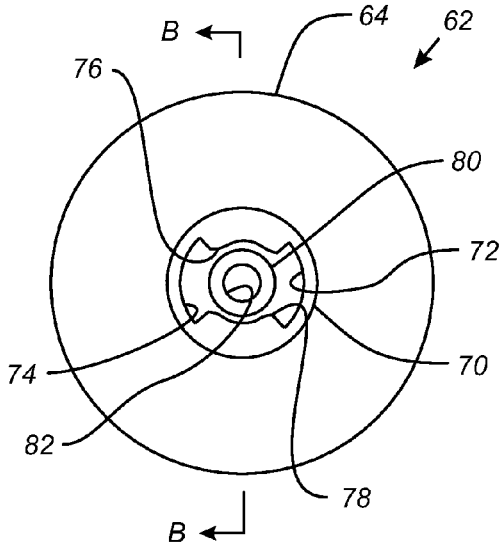
FIG. 6 shows a top plan view of the accessory of FIG. 5.
Figure 7:
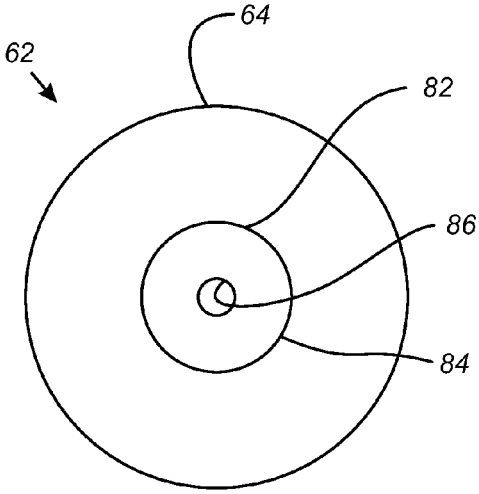
FIG. 7 shows a bottom plan view of the accessory of FIG. 5.
Figure 8:
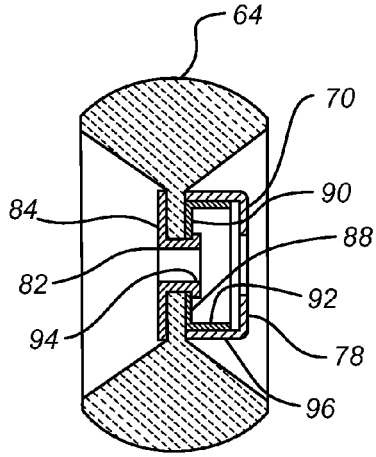
FIG. 8 shows a cross-sectional view of the accessory of FIG. 5.

Also visible in FIG. 6 is the inner portion 80 of a rivet 82 which is located on the side of the central hub 66 opposite to the slot 68. The outer portion 84 of the rivet 80 is shown in FIG. 7. In this embodiment, the rivet 82 is a hollow rivet, having a bore 86 therethrough. With reference to FIG. 8, the rivet 82 is spaced apart from the outer wall 70 by a spacer 88 which includes an inner wall portion 90 and a spacer portion 92. The inner wall portion 90 defines a spacer bore 94. The spacer portion 92 abuts an inwardly extending portion 96 of the outer wall 70.

The spacer 88 is made from a strong rigid metallic material which in this embodiment is stamped into a pan-like shape to form the spacer portion 92 and the inner wall portion 90. The outer wall 70 is likewise formed from a strong rigid metallic material which is stamped into a pan-like shape complimentary to the spacer 88 to form the inwardly extending portion 94. Both the spacer bore 94 and the slot 68 may be formed prior to or after the stamping of the respective component. Alternatively, the spacer bore 64 and the slot 68 may be formed during the stamping of the component. After stamping of the components, the spacer 88 is joined to the outer wall 70 by a friction fit between the spacer portion 92 and the inwardly extending portion 96. The spacer 88 may be joined to the outer wall 70 by other suitable means such as, but not limited to, welding, threading, and keying.

Once the spacer bore 94 has been formed, the work portion 64 is placed next to the inner wall portion 90 and the rivet 82 is inserted through the work portion 64 and the spacer bore 64. Compression of the rivet 82 results in compression of the work portion 64 and the inner wall 90 of the spacer 88 between the inner portion 80 of the rivet 82 and the outer portion 84 of the rivet 82.

In the embodiment of FIGS. 5-7, the work portion 64 of the buffing wheel 62 is an abrasive buffing pad made from an abrasive material such as type SB CPA (medium), WR-RL S (fine) or CF-SR A (very fine) available through 3M Company of St. Paul, Minn. The use of the rivet 82 in the assembly of the accessory 62 allows for a number of layers of material to be used in constructing the accessory 62. By way of example, the length of the shank portion of the rivet 82 may be selected to accommodate a plurality of discs or layers of material in the work portion 64. Accordingly, one, two or more layers of material may be compressed between the inner wall 90 of the spacer 88 and the outer portion 84 of the rivet 82. The layers may be of the same type of material to provide a thicker accessory. Alternatively, different layers may be provided from different types of materials to provide desired characteristics.

In alternative embodiments, the work portion may materials such as a microfiber buffing cloth made of fifty percent polyurethane and fifty percent nylon, commercially available from Hewitex Nederland B.V of The Netherlands, wires or other abrasive material so as to form a grinding wheel, a cut-off wheel a sanding disc, or any other similar accessory.

Figure 9:
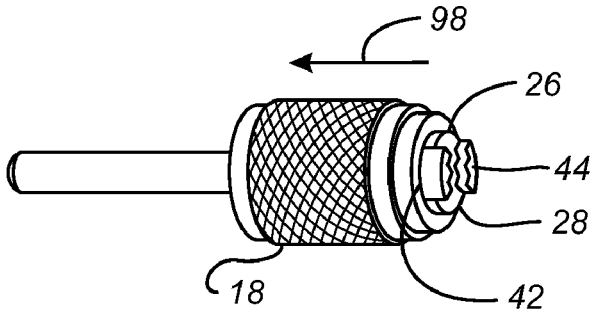
FIGS. 9-12 show perspective views of the mandrel assembly of FIG. 1 and a portion of the central hub of the accessory of FIG. 5 depicting a series of steps for mounting an accessory to the mandrel assembly.

With reference to FIGS. 2, 6 and 9-14, the manner of attaching the accessory 62, to the mandrel assembly 14 is now described. In FIG. 9, the collar 18 is in a first position with the spring 58 acting against the retainer 60 to force the shaft teeth 26 and 28 of the mandrel shaft 16 against the landing areas 50 and 52 of the collar 18. In this position, the collar teeth 42 and 44 extend slightly past and mesh with the shaft teeth 26 and 28.

Figure 10:
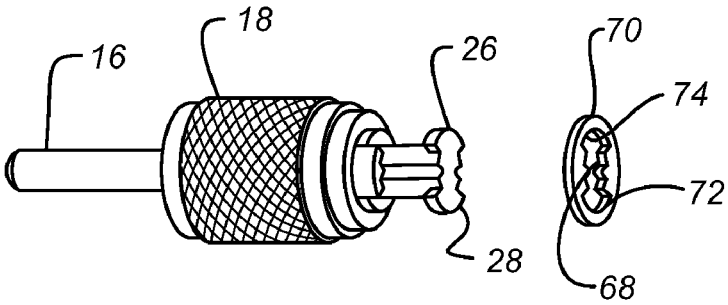

The collar 18 is retracted by applying sufficient force to the collar 18 to further compress the spring 58 thereby moving the collar 18 in the direction of the arrow 98 in FIG. 9 until the collar 18 is in the position shown in FIG. 10. In FIG. 10, the collar 18 is shown retracted to a second position with the spring 58 compressed between the retainer 60 and the circular head wall 38 and the shaft teeth 26 and 28 moved out of the plane of the collar teeth 42 and 44. When the collar 18 is in this second position, the slot 68 of the buffing wheel 62 is aligned with the shaft 16. Only the outer wall 70 and slot 68 of the buffing wheel 62 are shown in FIGS. 10-12 for purpose of clarity.

Once the slot 68 is aligned with the shaft 16, the shaft tooth 26 is passed through the fan shape portion 74 while the shaft tooth 28 is passed thorough the fan shape portion 72. In this embodiment, the fan shape portions 72 and 74 are symmetrical as are the shaft teeth 26 and 28. Thus, the shaft teeth 26 and 28 may alternatively be passed through the fan shape portions 72 and 74, respectively. In alternative embodiments, the shapes may be asymmetrical thereby ensuring that the accessory is mounted in a particular configuration. In further embodiments, the keys are in shapes other than fan shapes. Such alternative embodiments may be useful in ensuring that specific accessories are mounted on specific mandrels.

Figure 11:
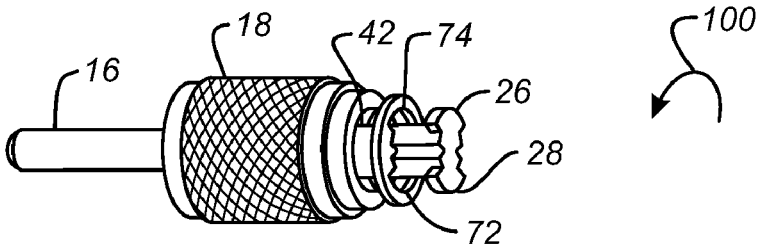
Figure 12:
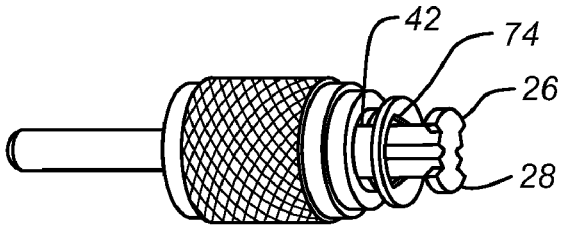

Returning now to the discussion of mounting the accessory 62 onto the mandrel assembly 14, the shaft 16 is further moved until the outer wall 70 is located about the first end portion 22 of the shaft 16 as shown in FIG. 11. In this position, the outer wall 70 is in a plane to the right of the plane defined by the collar teeth 42 and 44 and to the left of a plane defined by the shaft teeth 26 and 28.

Next, the accessory 62 is rotated with respect to the shaft 16. By way of example, the accessory 62, and thus the outer wall 70, may be rotated in the direction of the arrow 100. FIG. 12 shows the configuration of the outer wall 70 after rotation of ninety degrees. In this configuration, the collar tooth 42 is aligned with the fan shape portion 74 of the slot 68 and the second collar tooth 44 is aligned with the fan shape portion 72. Additionally, the protrusion 76 is between the landing area 52 and the shaft tooth 26 while the protrusion 78 is between the landing area 50 and the shaft tooth 28. At this point, the force against the collar 18 is reduced, thereby allowing the spring 58 to decompress thereby moving the collar 18 to the position shown in FIG. 13.

Figure 13:
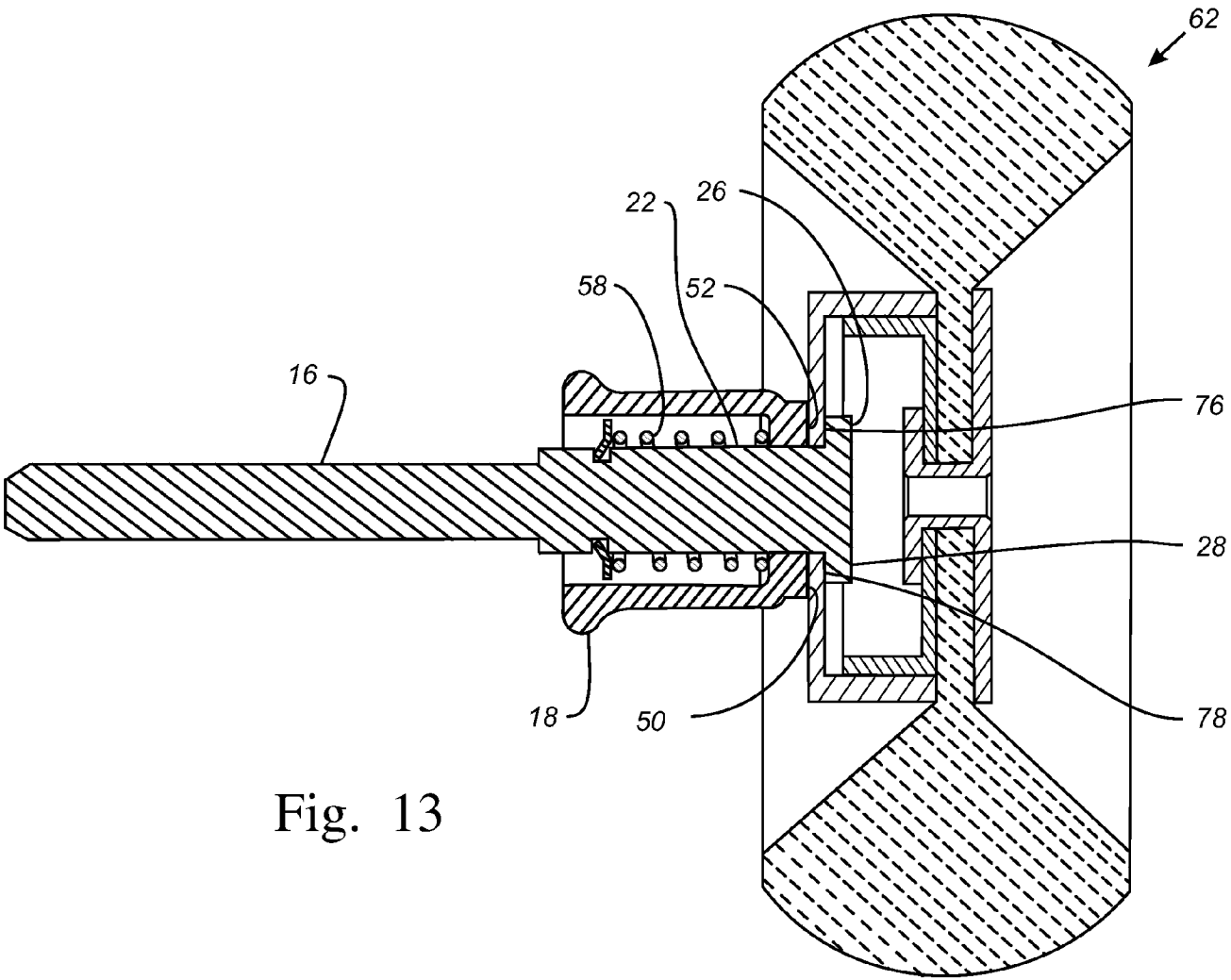
FIG. 13 shows a cross-sectional view of the accessory of FIG. 5 mounted on the mandrel assembly of FIG. 1 in accordance with principles of the present invention.

As shown in FIG. 13, the spring 58 has moved the collar 18 toward the first end 22 of the shaft 16 thereby constraining the protrusion 76 between the landing area 52 and the shaft tooth 26 while the protrusion 78 is constrained between the landing area 50 and the shaft tooth 28. At the same time, the buffing wheel 62 is prevented from rotating relative to the mandrel assembly 14, because the collar tooth 42 extends into the fan shape portion 74 of the slot 68 and the second collar tooth 44 extends into the fan shape portion 72. Additionally, the collar 18 is prevented from rotating relative to the mandrel shaft 16 because the tangs 46 and 48 of the collar teeth 42 and 44 remain in the elongated grooves 30 of the mandrel shaft 16.

As described above, an accessory 62 with a central hub 66 is disclosed that allows the accessory 62 to be quickly and conveniently coupled to a keyed mandrel assembly 14 without the need for an additional tool such as a screw driver. Likewise, by reversing the above-described actions, the accessory 62 may be quickly and conveniently decoupled from the mandrel assembly 14.

Figure 14:
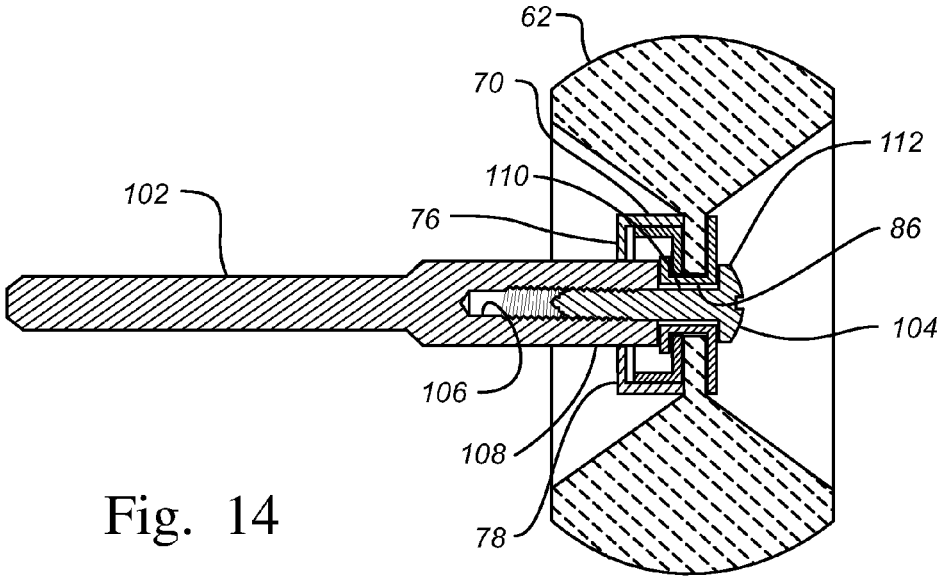
FIG. 14 shows a cross-sectional view of the accessory of FIG. 5 mounted to a threaded mandrel assembly with the threaded mandrel abutting the inner portion of a rivet on the accessory in accordance with principles of the present invention.

The central hub 66 may further be used, however, with mandrels that require an additional tool for coupling and decoupling an accessory. By way of example, FIG. 14 shows the buffing wheel 62 mounted on a threaded mandrel 102 with a screw 104. The buffing wheel 62 is oriented so that the side of the central hub 66 with the outer wall 70 faces toward the threaded mandrel 102. The screw 104 is inserted through the bore 86 and threaded into a threaded bore 106 in the upper portion 108 of the threaded mandrel 102. In this embodiment, the diameter of the bore 86 in the rivet 82 is selected to allow the shaft 110 of the screw 104 to pass through the bore 86. The head 112 of the screw 104, however, is too large to pass through the bore 86. Additionally, the upper portion 108 of the threaded mandrel 102 is sized to fit between the protrusions 76 and 78 while being configured to not pass through the bore 86. Accordingly, the accessory 62 may be clamped to the threaded mandrel 102 by compressing the rivet 82 between the head 112 of the screw 104 and the upper portion 108 of the threaded mandrel 102.

Figure 15:
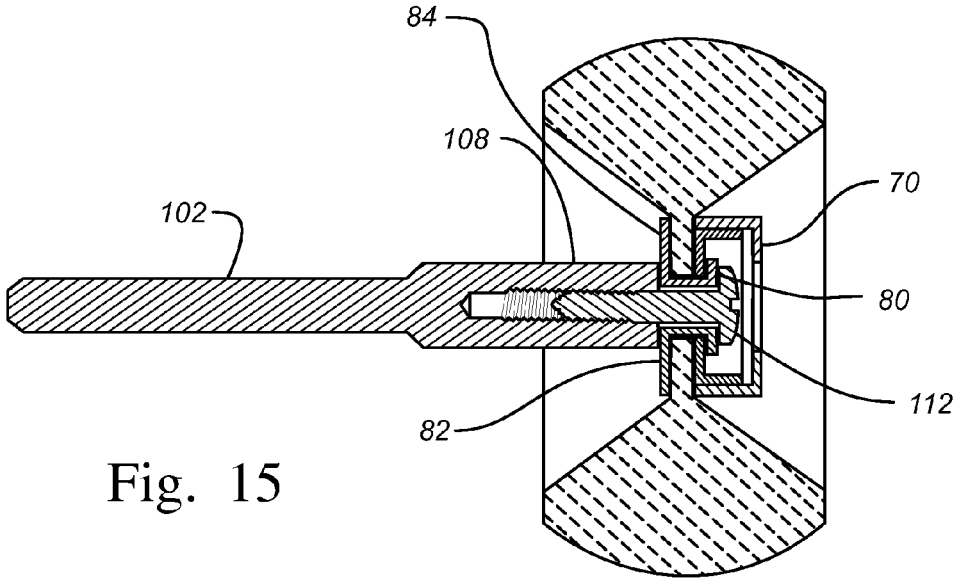
FIG. 15 shows a cross-sectional view of the accessory of FIG. 5 mounted to the threaded mandrel assembly of FIG. 14 with the threaded mandrel abutting the outer portion of the rivet in accordance with principles of the present invention.

Alternatively, the accessory 62 may be mounted in a reversed configuration such that the outer wall 70 of the central hub 66 is located away from the threaded mandrel 102 while the outer portion 84 of the rivet 80 abuts the upper portion 108 of the threaded mandrel 102 as shown in FIG. 15. In this configuration, the head 112 of the screw 104 is in contact with the inner portion 80 of the rivet 82.

Figure 16:
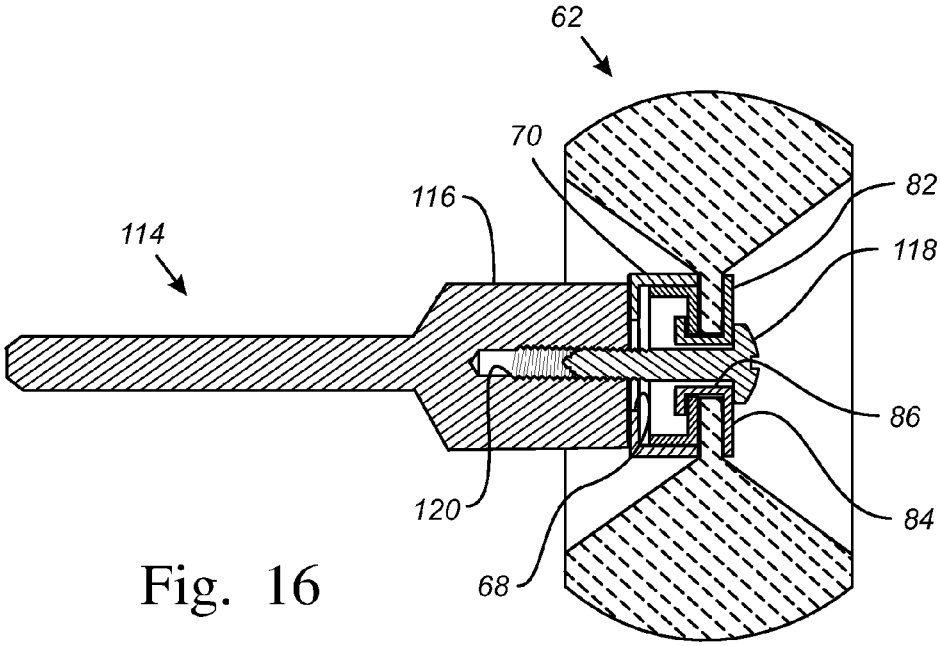
FIG. 16 shows a cross-sectional view of the accessory of FIG. 5 mounted to a threaded mandrel assembly with the threaded mandrel abutting the outer wall of the central hub of the accessory in accordance with principles of the present invention.

The buffing wheel 66 may also be mounted to a mandrel that has a diameter greater than the diameter of the slot 68 between the protrusions 76 and 78. As shown in FIG. 16, the mandrel 114 has an end portion 116 that is too large to be inserted within the slot 68 of the outer wall 70. Nonetheless, the buffing wheel 62 may be mounted to the mandrel 114 by placing the outer wall 70 against the end portion 116 of the mandrel 114. A screw 118 which extends through the rivet bore 86 and the slot 68 is threaded into a threaded bore 120 in the mandrel 114. The head 122 of the screw 118 is used to force the rivet 82 in the direction toward the mandrel 114, thereby forcing the outer wall 70 against the end portion 116 of the mandrel 114.

Figure 17:
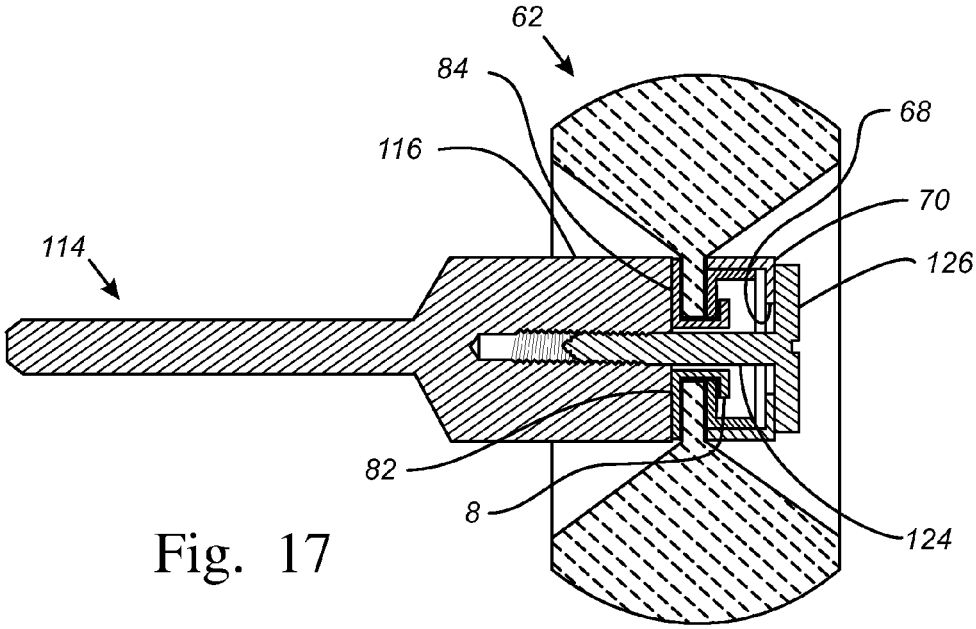
FIG. 17 shows a cross-sectional view of the accessory of FIG. 5 mounted to the threaded mandrel assembly of FIG. 16 using a screw with a head too large to fit through the slot of the central hub and with the threaded mandrel abutting the outer portion of the rivet of the central hub in accordance with principles of the present invention.

The buffing wheel 62 may alternatively be mounted in a reversed configuration with the end portion 116 of the mandrel 114 abutting the outer portion 84 of the rivet 82 as shown in FIG. 17. In this embodiment, the screw 124 has a head 126 that is too large to fit through the slot 68. Accordingly, the head 126 of the screw 124 is used to force the outer wall 70 in the direction toward the mandrel 114, thereby forcing the rivet 82 against the end portion 116 of the mandrel 114. By using a screw with a head sized to fit through the slot 68, such as the screw 104 of FIG. 14, substantially all of the compressive force may be passed directly through the rivet 82. This avoids cycling the load across the friction fit of the inwardly extending portion 96 of the outer wall 70 and the spacer portion 92 of the inner wall portion 90.

Although the present invention has been described with respect to certain preferred embodiments, those of skill in the art will appreciate that other implementations and adaptations are possible. For example, the central hub may be configured to receive differently shaped keys provided on a mandrel. Additionally, various types of mandrels may be configured with keys. U.S. patent application Ser. No. 11/187,139 and U.S. patent application Ser. No. 11/187,140 describe some of the alternative mandrels, including a mandrel with a retaining groove located on a mandrel shaft which may be used along with a retainer to provide biasing of the mandrel skirt. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A rotary tool accessory comprising:

a work portion; and a hub portion operably connected to the work portion for rotating the work portion, the hub portion including a first mandrel mounting portion on a first side of the hub portion for mounting with a first mandrel type and a second mandrel mounting portion on a second side of the hub portion for mounting with a second mandrel type, wherein the second mandrel type is different from the first mandrel type; wherein the second mandrel mounting portion comprises a slot for receiving a keyed portion of a mandrel; and the first mandrel mounting portion comprises a bore for receiving the shaft of a screw;

wherein the work portion defines a plane;

the first mandrel mounting portion is co-planar with the work portion plane; and the second mandrel mounting portion is spaced apart from the first mandrel mounting portion in a direction perpendicular to the work portion plane by a spacer.

2. The rotary tool accessory of claim 1, wherein:

the first mandrel mounting portion defines an opening sized to allow the shaft portion of a screw to pass therethrough and to not allow the head of the screw to pass therethrough; and the second mandrel mounting portion defines an opening configured to complimentarily receive a keyed mandrel.

3. The rotary tool accessory of claim 2, wherein the first mandrel mounting portion comprises a hollow rivet, the rivet defining the opening sized to allow the shaft portion of the screw to pass therethrough.

4. The rotary tool accessory of claim 2, wherein the second mandrel mounting portion further defines an opening having a length and a width, the width shorter than the length.

5. The rotary tool accessory of claim 4, the second mandrel mounting portion further comprising:

an inner wall portion coupled to the first mandrel mounting portion; and an outer wall portion spaced apart from the inner wall portion, wherein the outer wall portion defines the opening.

6. The rotary tool accessory of claim 5, wherein the work portion is held by the inner wall portion of the second mandrel mounting portion and the first mandrel mounting portion.

7. The rotary tool accessory of claim 6, wherein the working portion comprises a cloth for polishing.

8. The rotary tool accessory of claim 6, wherein the working portion comprises an abrasive for cutting.

9. The rotary tool accessory of claim 6, wherein the working portion comprises an abrasive for grinding.

10. The rotary tool accessory of claim 6, wherein the working portion comprises an abrasive for sanding.

11. The rotary tool accessory of claim 5, wherein:

the inner wall portion comprises a spacer portion extending toward the outer portion;

the outer wall portion of the second mandrel mounting portion comprises an inwardly extending portion extending toward the inner wall portion; and the inwardly extending portion frictionally engages the spacer portion.

12. The rotary tool accessory of claim 4, wherein the width of the opening varies along the length of the opening from a first wide portion to a narrow portion to a second wide portion.

13. The rotary tool accessory of claim 1, wherein:

the second mandrel mounting portion is configured to receive a complimentarily keyed mandrel for mounting the hub to the keyed mandrel; and the first mandrel mounting portion is configured to be compressed against a mandrel having a threaded bore, the second mandrel mounting portion defining a hole sized to allow the shaft of a screw to pass therethrough.

14. The rotary tool accessory of claim 13, wherein the second mandrel mounting portion defines an opening for receiving the keyed mandrel, the second mandrel mounting portion further comprising:

at least one protrusion extending into the opening for receiving rotational force from the keyed mandrel in the plane through which the opening is made.

15. The rotary tool accessory of claim 14, wherein the at least one protrusion is further configured to receive compressive force from the keyed mandrel through the plane in which the opening is placed.

16. The rotary tool accessory of claim 15, wherein the at least one protrusion comprises:

a first protrusion extending into the opening in a first direction; and a second protrusion extending into the opening in a direction opposite to the first direction.

17. The rotary tool accessory of claim 14, wherein the first mandrel mounting portion comprises an end portion of a rivet.

18. The rotary tool accessory of claim 17, further comprising:

a spacer defining a hole through which the rivet extends and configured to abut a second end of the rivet and to space the second mandrel mounting portion apart from the second end of the rivet.

19. The rotary tool accessory of claim 17, further comprising:

a spacer located between the first mandrel mounting portion and the second mandrel mounting portion for spacing the first mandrel mounting portion apart from the second mandrel mounting portion such that a key portion of a mandrel may be rotated between the first mandrel mounting portion and the second mandrel mounting portion.

20. The rotary tool accessory of claim 17, wherein:

the slot is in the shape of a bow-tie; and the first mandrel mounting portion comprises a hollow rivet.

* * * * *